US011220374B2

(12) United States Patent
Cameron et al.

(10) Patent No.: US 11,220,374 B2
(45) Date of Patent: Jan. 11, 2022

(54) PACKAGE CLOSURE FOR WITHSTANDING INTERNAL FORCES

(75) Inventors: David Cameron, Canandaigua, NY (US); Craig Soller, Farmington, NY (US); Michael Bohn, Rochester, NY (US); Roger E. Dowler, Rochester, NY (US); Janet Fleury, Canandaigua, NY (US)

(73) Assignee: REYNOLDS PRESTO PRODUCTS INC., Appleton, WI (US)

( * ) Notice: Subject to any disclaimer, the term of this patent is extended or adjusted under 35 U.S.C. 154(b) by 0 days.

(21) Appl. No.: 12/910,487

(22) Filed: Oct. 22, 2010

(65) Prior Publication Data

US 2011/0033138 A1 Feb. 10, 2011

Related U.S. Application Data

(63) Continuation of application No. PCT/US2009/041552, filed on Apr. 23, 2009.
(Continued)

(51) Int. Cl.
*B65D 33/25* (2006.01)
*B65B 43/00* (2006.01)
*B65B 7/02* (2006.01)

(52) U.S. Cl.
CPC ..... *B65D 33/2591* (2013.01); *B65D 33/2525* (2013.01); *B65D 2401/05* (2020.05)

(58) Field of Classification Search
CPC ..... B65D 33/25; B65D 33/2508; B65D 33/2516; B65D 33/2525; B65D 33/2533;
(Continued)

(56) References Cited

U.S. PATENT DOCUMENTS 3,198,228 A 8/1965 Naito
3,217,871 A 11/1965 Lee
(Continued)

FOREIGN PATENT DOCUMENTS

EP 1 223 111 A 7/2002
EP 1223111 A2 * 7/2002 ..... B65D 33/25
(Continued)

OTHER PUBLICATIONS

International Search Report dated Jul. 6, 2009.
(Continued)

*Primary Examiner* — Jes F Pascua
*Assistant Examiner* — Nina K Attel
(74) *Attorney, Agent, or Firm* — Baker Botts L.L.P.

(57) ABSTRACT

A reclosable package comprises a first panel having first and second side sections and a second panel having first and second side sections. The first panel opposes the second panel and is joined to the second panel along the first and second side sections. A bottom extends between the first and second side sections of the first and second panels with the first and second panels joined to each other. A mouth is disposed opposite the bottom and extends between the first and second side sections of the first second panels. A closure member extends along the mouth, with the closure member including a first fin joined to the first panel and second fin joined to the second panel. A sealing member having a first and second ends is disposed proximate the mouth. The ends of the sealing member can be attached to the fin or panel such that at least one of the first end or second ends of the sealing member is attached with peelable seal.

13 Claims, 12 Drawing Sheets

Related U.S. Application Data

(60) Provisional application No. 61/047,327, filed on Apr. 23, 2008.

(58) Field of Classification Search
CPC ..... B65D 33/2541; B65D 33/255; B65D 33/2558; B65D 33/2566; B65D 33/2575; B65D 33/2583; B65D 33/2584; B65D 33/2585; B65D 33/2586; B65D 33/25865; B65D 33/2587; B65D 33/2588; B65D 33/2589; B65D 33/259; B65D 33/2591; B65D 2401/05
USPC ..... 383/210, 210.1, 5, 61.1, 63–65; 53/469, 53/424, 412, 452, 459, 467, 473
See application file for complete search history.

(56) References Cited

U.S. PATENT DOCUMENTS

| | | | | |
|---|---|---|---|---|
| 3,256,981 | A | 6/1966 | Kurtz | |
| 3,329,331 | A | 7/1967 | Morgan | |
| 3,339,606 | A | 9/1967 | Kugler | |
| 3,368,740 | A | 2/1968 | Rohde | |
| 3,511,436 | A | 5/1970 | Kessler | |
| 3,535,409 | A | 10/1970 | Rohde | |
| 3,613,874 | A | 10/1971 | Miller | |
| 3,625,270 | A | 12/1971 | Skendzic | |
| 3,655,503 | A | 4/1972 | Stanley et al. | |
| 3,711,011 | A | 1/1973 | Kugler | |
| 3,791,916 | A | 2/1974 | Eastes | |
| 3,827,625 | A | 8/1974 | Miller | |
| 3,967,729 | A | 7/1976 | Tanner, II | |
| 4,097,236 | A | 6/1978 | Daly et al. | |
| 4,279,677 | A | 7/1981 | Takahashi | |
| 4,295,919 | A | 10/1981 | Sutrina et al. | |
| 4,355,494 | A | 10/1982 | Tilman | |
| 4,522,305 | A | 6/1985 | Jacobsson | |
| 4,576,285 | A | 3/1986 | Goglio | |
| 4,589,145 | A | 5/1986 | Van Erden et al. | |
| 4,630,311 | A | 12/1986 | Bentson | |
| 4,638,913 | A | 1/1987 | Howe, Jr. | |
| 4,663,915 | A | 5/1987 | Van Erden et al. | |
| 4,705,174 | A | 11/1987 | Goglio | |
| 4,736,451 | A | 4/1988 | Ausnit | |
| 4,738,998 | A | 4/1988 | Uffner et al. | |
| 4,784,885 | A | 11/1988 | Carespodi | |
| 4,785,937 | A | 11/1988 | Tamezawa et al. | |
| 4,834,552 | A | 5/1989 | Makowka | |
| 4,846,585 | A | 7/1989 | Boeckmann et al. | |
| 4,855,168 | A | 8/1989 | Imaizumi | |
| 4,875,587 | A | 10/1989 | Lulham et al. | |
| 4,889,731 | A | 12/1989 | Williams, Jr. | |
| 4,915,289 | A | 4/1990 | Hatano et al. | |
| 4,923,309 | A | 5/1990 | Van Erden | |
| 4,925,316 | A | 5/1990 | Van Erden et al. | |
| 4,925,318 | A | 5/1990 | Sorensen | |
| 4,937,040 | A | 6/1990 | Holcomb et al. | |
| 4,944,409 | A | 7/1990 | Busche et al. | |
| 4,949,527 | A * | 8/1990 | Boeckmann et al. | 53/412 |
| 4,966,470 | A | 10/1990 | Thompson et al. | |
| 4,969,967 | A | 11/1990 | Sorensen et al. | |
| 4,977,206 | A | 12/1990 | Hwo et al. | |
| 4,998,666 | A | 3/1991 | Ewan | |
| 4,999,967 | A | 3/1991 | Hoffmann | |
| 5,017,021 | A | 5/1991 | Simonsen et al. | |
| 5,022,530 | A | 6/1991 | Zieke | |
| 5,024,888 | A | 6/1991 | Hwo et al. | |
| 5,033,868 | A | 7/1991 | Peppiatt | |
| 5,063,069 | A | 11/1991 | Van Erden et al. | |
| 5,064,664 | A | 11/1991 | Hustad et al. | |
| 5,067,822 | A | 11/1991 | Wirth et al. | |
| 5,077,001 | A | 12/1991 | Makowka | |
| 5,082,702 | A | 1/1992 | Alband | |
| 5,103,979 | A | 4/1992 | Hustad | |
| 5,104,704 | A | 4/1992 | Labes et al. | |
| 5,121,997 | A | 6/1992 | La Pierre et al. | |
| 5,143,961 | A | 9/1992 | Scholl et al. | |
| 5,198,055 | A | 3/1993 | Wirth et al. | |
| 5,215,380 | A | 6/1993 | Custer et al. | |
| 5,224,779 | A | 7/1993 | Thompson et al. | |
| 5,238,306 | A | 8/1993 | Heintz et al. | |
| 5,330,269 | A | 7/1994 | Kamada et al. | |
| 5,346,301 | A | 9/1994 | Scarberry et al. | |
| 5,358,334 | A | 10/1994 | Simonsen | |
| 5,360,845 | A | 11/1994 | Billmers et al. | |
| 5,407,278 | A | 4/1995 | Beer | |
| 5,425,825 | A | 6/1995 | Rasko et al. | |
| 5,456,928 | A | 10/1995 | Hustad et al. | |
| 5,470,156 | A | 11/1995 | May | |
| 5,474,382 | A | 12/1995 | May | |
| 5,486,051 | A | 1/1996 | May | |
| 5,489,252 | A | 2/1996 | May | |
| 5,492,411 | A | 2/1996 | May | |
| 5,509,735 | A | 4/1996 | May | |
| 5,513,915 | A | 5/1996 | May | |
| 5,525,363 | A | 6/1996 | Herber et al. | |
| 5,538,345 | A | 7/1996 | Gotoh et al. | |
| 5,551,127 | A | 9/1996 | May | |
| 5,582,887 | A | 12/1996 | Etheredge | |
| 5,604,000 | A | 2/1997 | May | |
| 5,647,671 | A | 7/1997 | May | |
| 5,725,312 | A | 3/1998 | May | |
| 5,733,636 | A | 3/1998 | May | |
| 5,767,184 | A | 6/1998 | May | |
| 5,769,772 | A | 6/1998 | Wiley | |
| 5,887,980 | A | 3/1999 | May | |
| 5,893,645 | A | 4/1999 | May | |
| 5,904,425 | A | 5/1999 | May | |
| 6,154,934 | A | 12/2000 | Matthews | |
| 6,290,391 | B1 * | 9/2001 | Buchman | 383/5 |
| 6,354,738 | B1 | 3/2002 | Buckman et al. | |
| 6,378,177 | B1 * | 4/2002 | Athans et al. | 24/585.12 |
| 6,713,152 | B2 * | 3/2004 | Chen et al. | 428/99 |
| 6,799,890 | B2 * | 10/2004 | Schneider | B65D 33/2591 383/203 |
| 6,845,598 | B1 * | 1/2005 | Melchoir | 53/412 |
| 6,918,230 | B2 * | 7/2005 | Thieman | 53/412 |
| 7,306,370 | B2 | 12/2007 | Howell et al. | |
| 2001/0053253 | A1 * | 12/2001 | Buchman et al. | 383/5 |
| 2002/0094138 | A1 * | 7/2002 | Schneider | 383/5 |
| 2002/0100144 | A1 | 8/2002 | Machacek et al. | |
| 2003/0096042 | A1 * | 5/2003 | Strand et al. | 426/122 |
| 2003/0198407 | A1 * | 10/2003 | Rehwinkel et al. | 383/61.2 |
| 2005/0063617 | A1 | 3/2005 | Tilman | |
| 2006/0030471 | A1 * | 2/2006 | Schaller | B65D 33/2533 493/213 |
| 2007/0183692 | A1 | 8/2007 | Pawloski | |
| 2008/0019619 | A9 * | 1/2008 | Eads et al. | 383/61.2 |

FOREIGN PATENT DOCUMENTS

| | | | |
|---|---|---|---|
| EP | 1 366 999 | A1 | 12/2003 |
| EP | 1 721 833 | A1 | 11/2006 |
| JP | 2000-287718 | A | 10/2000 |
| JP | 2002225889 | A | 8/2002 |
| JP | 2002284196 | A | 10/2002 |
| JP | 2006111277 | A | 4/2006 |
| JP | 2007-261640 | | 10/2007 |
| JP | 2007-331805 | | 12/2007 |
| WO | WO 2002/00520 | | 1/2002 |
| WO | WO 2004/050487 | | 6/2004 |
| WO | WO 2005/077773 | | 8/2005 |
| WO | WO 2006/041057 | | 4/2006 |
| WO | WO 2006/090693 | A1 | 8/2006 |

OTHER PUBLICATIONS

Extended European Search Report for EP 12154536.2, dated Mar. 14, 2012.

JP Office Action dated Aug. 4, 2015 in JP Patent Application No. 2014-130330.

EP Extended Search Report dated Aug. 10, 2015 in EP Application No. 15152633.2.

(56) References Cited

OTHER PUBLICATIONS

European Search Report dated Jan. 7, 2019 in EP Application No. 18185284.

* cited by examiner

PACKAGE CLOSURE FOR WITHSTANDING INTERNAL FORCES

CROSS-REFERENCE TO RELATED APPLICATIONS

The present application is a continuation of International Application No. PCT/US09/041552, filed Apr. 23, 2009 which claims the benefit of U.S. Provisional Application No. 61/047,327, filed Apr. 23, 2008, each of these applications are hereby incorporated by reference in their entireties.

BACKGROUND OF THE DISCLOSED SUBJECT MATTER

Field of the Disclosed Subject Matter

The present disclosed subject matter relates to package closures for with standing elevated internal forces. Particularly, the present disclosed subject matter is directed to package closures having a primary seal and a secondary seal, to provide packages of optimum fitness and convenience for consumer use.

Description of Related Art

Packages such as polymeric bags are widely used in a diverse number of households, as well as commercial facilities. Polymeric bags are used for a wide range of applications, such as for storage and food packaging, for example. One advantage of polymeric bags is that they are relatively cost efficient and can be reused if desired. Further, polymeric bags having a closure assembly provide a bag that is easily opened and reclosed. Reclosable bags often include a closure assembly such as a reclosable fastener or slider mechanism. Advantageously, the closure feature enables the bag to be reopened and reclosed countless times.

There are a variety of reclosable bags in which a fastener interlock is augmented by a breakable or peelable seal for hermetic and/or tamper evident sealing purposes. However, such packages do not provided a suitable hermetic and/or tamper evident seal having a high resistance to the internal opening forces generated in heavier content packages due to elevated fill loads. Therefore, large packages, bags or pouches, such as those used for pet food, charcoal, cat litter, rice and similar items are typically filled and sealed shut, with no closure mechanism. These packages may be formed by form fill and seal (FFS) or by other methods. Prior attempts to incorporate a fastener closure mechanism have been unsatisfactory due to the unique requirements of a large bag with a relatively heavy load.

In particular, filling from the bottom places the load directly on the closure during the filling process, which can cause the fastener closure to fail and open. Similarly, dropping a filled bag onto a pallet or similar rough handling during transportation can cause the fastener closure to fail. Side gusseted bags are particularly prone to closure failure since the front and rear bag panels are displaced a greater distance than non-gusseted bags, thereby producing a higher load which is concentrated near the middle of the bag, and absorbed by the closure mechanism.

Some examples of prior art package closures include U.S. Pat. Nos. 4,252,846, 5,725,312, 6,131,248, 6,183,134, 6,290,393 6,901,637, 7,213,305 as well as U.S. Patent Application Publication Numbers 2008/0050052, 2008/0050056, 2008/0047228, each of which is herein incorporated by reference, in its entirety. Such conventional methods and systems generally have been considered satisfactory for their intended purpose, however there remains a demand for simplified closure configurations, as well as a reduction in force required by the consumer to access the contents of the bag.

Therefore, there remains a need for an efficient and economic method and system for providing a package closure capable of withstanding elevated internal loads which requires little or no modifications to the production film or package manufacturing apparatus.

SUMMARY OF THE DISCLOSED SUBJECT MATTER

The purpose and advantages of the present disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a reclosable package comprising a first panel including a first side section and a second side section and a second panel including a first side section and a second side section such that the first panel opposes the second panel and is joined to the second panel along the first and second side sections. A bottom connects the first and second panels to each other, and a reclosable top is disposed opposite the bottom and extends between the first and second side sections of the first and second panels. A closure assembly extends along the reclosable top and is configured to open and close the reclosable top, the closure assembly includes a first fin joined to the first panel and a second fin joined to the second panel. A sealing member is also provided having a first end and a second end, the first end joined to the first fin and the second end joined to the second fin, wherein at least one of the first end or second end is joined with a peelable seal.

The first end of the sealing member can be joined to the fin with a peelable seal, and the second end of the sealing member can be joined to the fin with a lock-up seal. Additionally, the first end of the sealing member can be joined to the first fin with a peelable seal, and the second end of the sealing member can be joined to the second fin with a peelable seal. Also, the first end of the sealing member can be integrally formed with the first fin and the second end of the sealing member can be joined to the second fin with a peelable seal.

In some embodiments, the reclosable package further comprises a membrane having a first end joined to the first fin and a second end joined to the second fin, with a line of weakness formed at a point between the first and second ends. The membrane can be disposed below the sealing member, or above the sealing member.

The sealing member can be a separately formed member which can be removed from the reclosable package, and the peelable seal can be formed by adhesives, heat-seal, or ultrasonic bonding, or by other methods and technologies well known in the art.

In another embodiment, a reclosable package comprises a first panel including a first side section and a second side section, and a second panel including a first side section and a second side section, with the first panel opposing the second panel and joined to the second panel along the first and second side sections. A bottom connects the first and second panels to each other, and a reclosable top is disposed opposite the bottom and extends between the first and second side sections of the first and second panels. A closure assembly extends along the reclosable top and is configured to open and close the reclosable top, the closure assembly including a first fin member joined to the first panel and a second fin member joined to the second panel. Also included is a sealing member having a first end and a second end, the first end is joined to a fin member and the second end is joined to a panel, wherein at least one of the first end of the sealing member or the second end of the sealing member is joined with a peelable seal.

The first end of the sealing member can be joined to the first fin with a lock-up seal, and the second end of the sealing member can be joined to a panel with a peelable seal. Additionally, the sealing member can include a line of weakness formed at a point between the first and second ends. Further, the sealing member includes an intermediate portion disposed between the first and second ends, with the intermediate portion joined to the second fin with a lock-up seal. The first end of the sealing member and the fin member can be integrally formed, or alternatively, the sealing member, panels, and fins can be separately formed.

In another embodiment, a reclosable package comprises a first panel including a first side section and a second side section, and a second panel including a first side section and a second side section, with the first panel opposing the second panel and joined to the second panel along the first and second side sections. A bottom connects the first and second panels to each other, and a reclosable top is disposed opposite the bottom and extends between the first and second side sections of the first and second panels. A closure assembly extends along the reclosable top and is configured to open and close the reclosable top, the closure assembly including a first fin member joined to the first panel and a second fin member joined to the second panel, wherein the first fin is joined to the second panel with a peelable seal.

Further, the first fin extends below the closure assembly a first distance, and the second fin extends below the closure assembly a second distance, wherein the first distance is greater than the second distance. An upper portion of the first fin can be joined to the first panel with a lock-up seal, and a lower portion of the first fin can be joined to the second panel with a peelable seal. The second fin can be joined to the second panel with a lock-up seal. The first fin member can be integrally connected to the second fin member, and the integral fin member can be joined to the second panel with two peelable seals.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE PREFERRED EMBODIMENT

Reference will now be made in detail to the present preferred embodiments of the disclosed subject matter, examples of which are illustrated in the accompanying drawings. The method and corresponding steps of the disclosed subject matter will be described in conjunction with the detailed description of the system.

In accordance with the disclosed subject matter, a bag is provided having a closed bottom, a reclosable top disposed opposite the bottom, and opposing first and second panels joined to each other. The bag further includes a closure assembly disposed along the reclosable top of the bag. In some embodiments, the closure assembly includes a press to close fastener configuration, or alternatively, a slider device mounted on the fastener closure to facilitate opening and closing of the closure assembly. The slider device is constructed to separate the interlocking fastener closure profiles when the slider device is moved in a first direction along the fastener, and to engage the interlocking fastener profiles when the slider device is moved in a second, opposite direction along the fastener. An example of such a fastener closure and slider device is disclosed in U.S. Pat. No. 7,263,748, the entirety of which is hereby incorporated by reference.

Figure 1:
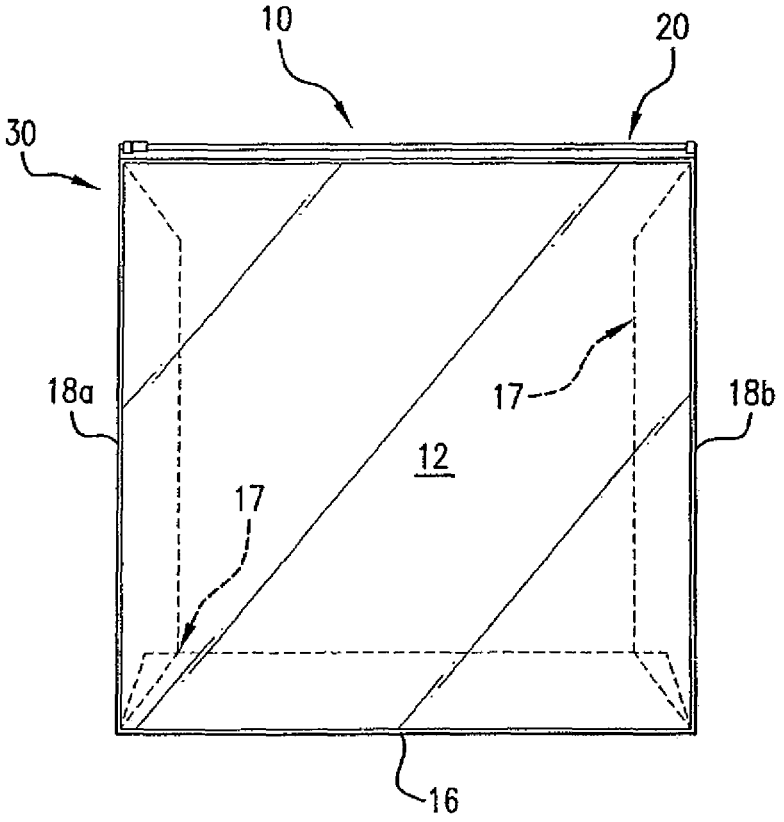
FIG. 1 is a schematic representation of the reclosable package in accordance with the disclosed subject matter.

For purpose of explanation and illustration, and not limitation, an exemplary embodiment of the system in accordance with the disclosed subject matter is shown in FIG. 1 and is designated generally by reference character 10. Additional features, aspects and embodiments of a package in accordance with the disclosed subject matter are provided in FIGS. 2-17, as will be described below.

As shown in FIG. 1 bag 10 comprises first and second opposing body panels 12, 14. In one embodiment, body panels 12, 14 are joined or fixedly connected to each other along first and second side sections 18*a*, 18*b*, respectively. As shown in FIG. 1, bottom 16 extends between the first and second side sections 18*a*, 18*b*. Further, bottom 16 connects the first panel 12 to the second panel 14. In some embodiments, the bag 10 can be configured with gussets as illustrated by reference numeral 17, either along the bottom or along the side sections, or both if so desired.

The first and second panels 12, 14 can be made from two separate sheets joined along three sides, e.g., bottom and opposing side sections. Alternatively, the first and second panels can be formed from a unitary folded sheet. The unitary sheet can include a side fold or a bottom fold.

First and second panels 12, 14 can be formed from a wide range of materials. Preferably, the panels are formed from polymeric material, for example and not limitation, polyesters; polystyrenes; nylon; polypropylene; polyethylene; copolymers of polyethylene and polypropylene; polycarbonates; polyacetals; acrylic-butadiene-styrene copolymers; monolayer or multilayer polyethylene, such as a low density polyethylene (LDPE), a linear low density polyethylene (LLDPE), high density polyethylenes (HDPE), and/or ethylene vinyl acetate, and/or a co-polymer mixture, multilayer combination, or laminate(s) thereof; or combinations thereof. However, as would be recognized in the art, other thermoplastic materials may be used to form the panels of the bag. Additionally, bag panels 12, 14 can be formed from any woven material such as a web of paper, cardboard, fabric, or any other suitable material.

In addition, the first and second panels of the bag may be formed from co-extruded films having two or more layers. Each of the first and second panels preferably has a thickness ranging from about 0.4 mil to about 10 mils. In one preferred embodiment, the thickness is 3.5 mils. However, depending on the application contemplated for the bag, other thicknesses may be used, if desired.

In a further aspect of the disclosed subject matter, the closure assembly can include a fastener configured to open and close the reclosable top section of the bag. In one embodiment, the fastener comprises a first fastener track attached to a first side panel and a second fastener track attached to a second side panel, wherein first and second fastener tracks are disposed in an opposing relationship on the first and second panels, respectively. The tracks may comprise integrally formed profiles and fins. In another embodiment, the closure assembly fastener may be configured to be operated by finger pressure or by an auxiliary squeezing device, whereby the first and second tracks are squeezed together (e.g., as in a press-to-close fastener). In this manner, the closure assembly fastener includes first and second tracks configured to form an interlocking connection by the application of a force.

Figure 2:
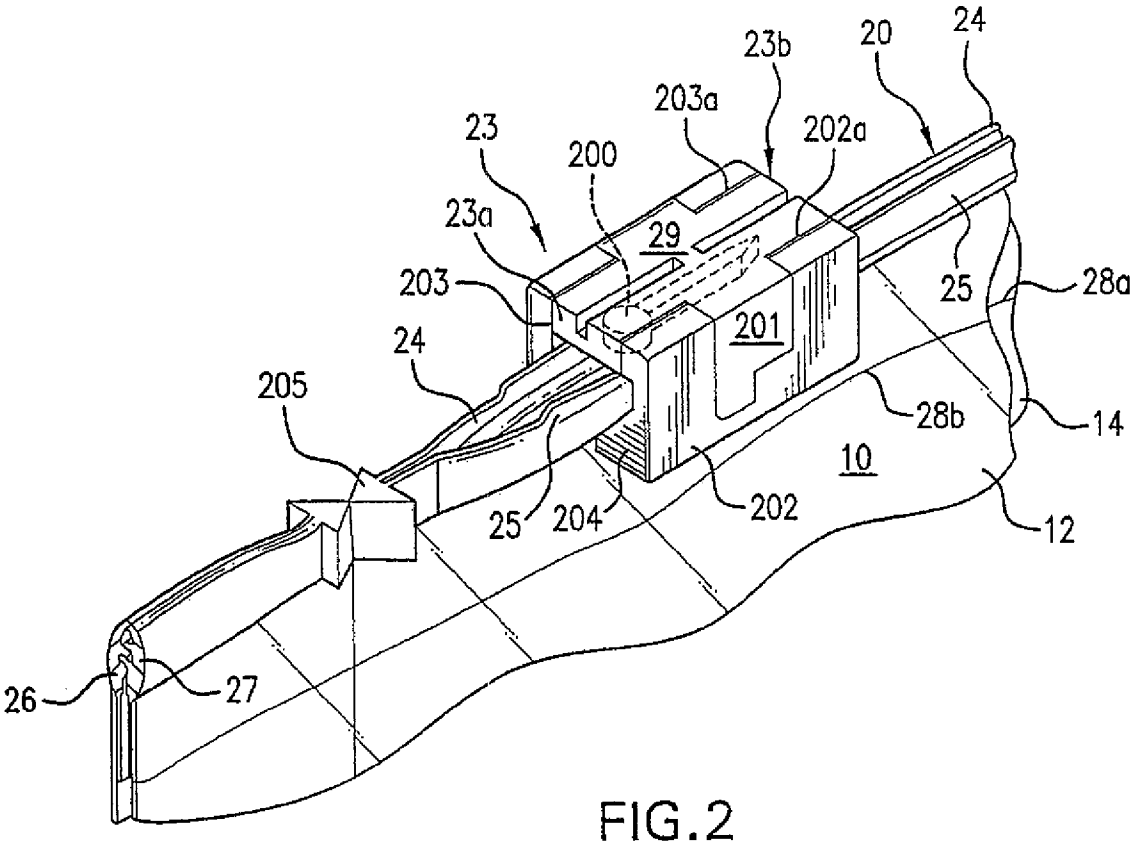
FIG. 2 is an enlarged perspective view of one embodiment of the closure assembly in accordance with the disclosed subject matter.

In one exemplary embodiment, the closure assembly includes a reclosable fastener. In this manner, the reclosable fastener is operated by the use of an auxiliary slider mechanism, by finger pressure, or by an auxiliary squeezing device. As shown in FIG. 2, the closure assembly is a fastener 20 including a slider mechanism 23, and first track 24, and second track 25 configured to form an interlocking connection.

For example and not limitation, first and second tracks can include complementary rib 26 and groove 27 profiles which extend along a length of the closure assembly. The rib and groove profiles 26, 27 are configured to have complementary cross-sectional shapes. The cross-sectional shapes of the interlocking rib and groove profiles 26, 27 shown in FIG. 2 are the subject of the disclosed subject matter claimed in U.S. Pat. No. 5,007,143 to Herrington, which is incorporated herein by reference in its entirety. In this manner, the ribs 26 form a mating relationship with corresponding grooves 27.

The rib track 24 includes a rib profile 26 and a first depending fin or flange 28*a* extending downward from the rib profile 26. Likewise, the groove track 25 includes a groove profile 27 and a second depending fin or flange 28*b* extending downward from the groove profile 27. The fins 28*a*, 28*b* are shown attached to opposing body panels 12, 14. The tracks 24, 25 may be extruded separately with fins 28*a*, 28*b* and attached to the respective sides of the bag mouth or the tracks 24, 25 may be extruded integral with the sides of the bag mouth. If the tracks 24, 25 are extruded separately, they are most effectively attached by means of the respective first and second fins 28*a*, 28*b*, incorporated within the tracks, such as by heat sealing to the bag mouth.

In one embodiment, slider 23, as illustrated in FIG. 2, and described in U.S. Pat. No. 5,896,627 to Cappel et al., which is incorporated herein by reference in its entirety, is slidingly mounted to closure assembly 20 disposed at the reclosable top of the bag 10. The slider 23 is configured to facilitate the engagement and disengagement of the first and second tracks 24, 25 of the closure assembly. In this manner, slider 23 is configured to transition between a closed position in which the first and second tracks are engaged, and an open position in which the first and second tracks are disengaged.

As the slider transitions from a closed position to an open position, first and second tracks 24, 25 progressively disengage to define an open bag so that a user can gain access to the interior of the bag 10. Further, movement of the slider 23 from an open position to a closed position facilitates the interlocking connection between the first and second tracks, e.g., rib and groove profiles 26, 27, thereby restricting access to the interior of the bag 10. For example, the rib and groove profiles 26, 27 may be rolled or pressed into their interlocking arrangement so as to securely close the bag by one of two means. First, the profiles may be rolled or pressed together at one end by a user and then sequentially fitted together along the length of the closure assembly by the user running a finger along the length of the closure assembly on each side of the profiles. Alternatively, the bag may include a slider that rides along the tracks of the closure assembly. If the slider is pulled in one direction, the bag is closed; if the slider is pulled in the opposite direction, the bag is reopened.

In one embodiment, as shown in FIG. 2, the slider 23 comprises an inverted generally U-shaped member including a transverse support member or body 29 from which the separator finger 200 extends downward. The body 29 is itself U-shaped and includes two integral legs 201 extending downward. The finger 200 is positioned between the legs 201. The body 29 is adapted to move along the top edges of the tracks 24, 25 with the legs 201 straddling these elements and the finger 200 positioned between the tracks 24, 25. The slider 23 also includes a pair of hinged "wings" 202, 203 that can be folded down into their final position. The wings 202, 203 are hinged to the main slider body 29 by means of hinge structures 202*a*, 203*a* located at the opposite ends of the legs 201.

The foldable depending wings or side walls 202, 203 extend from an opening end 23*a* of the slider 23 to a closing end 23*b*. It is noted that the main slider body 29 and the separator finger 200 are wider at the opening end 23*a* than at the closing end 23*b*. Similarly, the side walls 202, 203 and the legs 201 are spaced wider apart at the opening end 23*a* of the slider 23 to permit separation of the rib and groove profiles 26, 27 by the finger 200 engaging the tracks 24, 25. The wings 202, 203 and legs 201 are spaced sufficiently close together at the closing end 23*b* of the slider to press the rib and groove profiles 26, 27 into an interlocking relationship as the slider 23 is moved in a closure assembly closing direction. As shown in FIG. 2, the side walls 202, 203 at their lower ends are provided with an inwardly extending shoulder structure 204. Shoulder structure 204 engages a bottom of the closure assembly 20 to prevent slider 23 from being lifted off the edges of the tracks 24, 25 while the slider 23 straddles the closure assembly 20.

The slider 23 may be molded from any suitable polymeric material including, but not limited to, polyesters; polystyrenes; nylon; polypropylene; polyethylene; copolymers of polyethylene and polypropylene; polycarbonates; polyacetals; acrylic-butadiene-styrene copolymers; monolayer or multilayer polyethylene, such as a low density polyethylene (LDPE), a linear low density polyethylene (LLDPE), high density polyethylenes (HDPE), and/or ethylene vinyl acetate, and/or a co-polymer mixture, multilayer combination, or laminate(s) thereof; or combinations thereof.

The opposing ends of the closure assembly 20 can include end stop structures 205 as shown in FIG. 1 and U.S. Pat. No. 7,267,856 to Patel et al., which is incorporated herein by reference in its entirety. A portion of the end stop structures protrudes from the closure assembly 20 a distance adequate to engage the slider 23 and prevent the slider 23 from going past the respective ends of the closure assembly 20 and coming off the ends of the bag 10. A portion of the end stops may protrude an adequate distance in the transverse direction to engage the slider 23 and prevent movement of the slider 23 past the respective ends of the closure assembly 20. As used herein, transverse means any direction which is normal to the axis of the track.

For example, a portion of the end stops may protrude an adequate distance in a generally horizontal or generally vertical direction to engage the slider 23 and prevent movement of the slider 23 past the respective ends of the closure assembly 20. Additionally or alternatively, a portion of the end stops may protrude an adequate distance upwardly and/or outwardly from a remainder of the closure assembly 20 to engage the slider 23 and prevent movement of the slider 23 past the respective ends of the closure assembly 20. Additional details concerning the formation of the end stops may be obtained from U.S. Pat. No. 5,131,121 to Herrington, which is incorporated herein by reference in its entirety. In some embodiments, the thicknesses of the end stops at their widest point may vary from generally about 0.005 inches to about 0.2770 inches.

Figure 3:
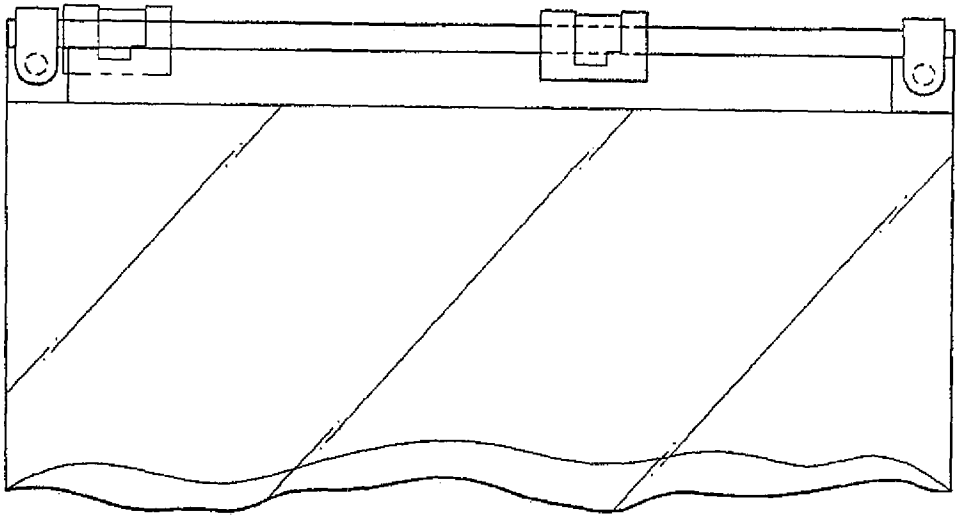
FIG. 3 is a front view of an embodiment of the reclosable fastener with a slider.
Figure 4:
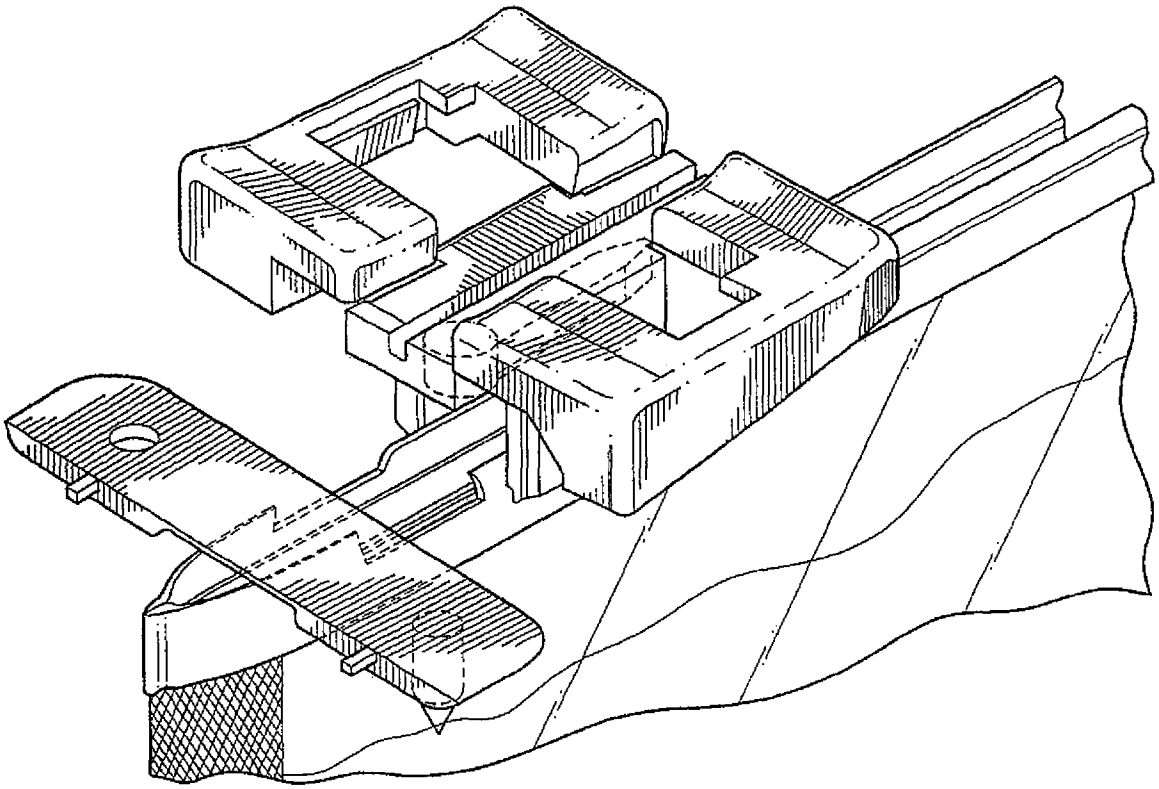
FIG. 4 is a perspective view of the reclosable fastener with the slider shown in the open position preparatory to assembly.
Figure 5:
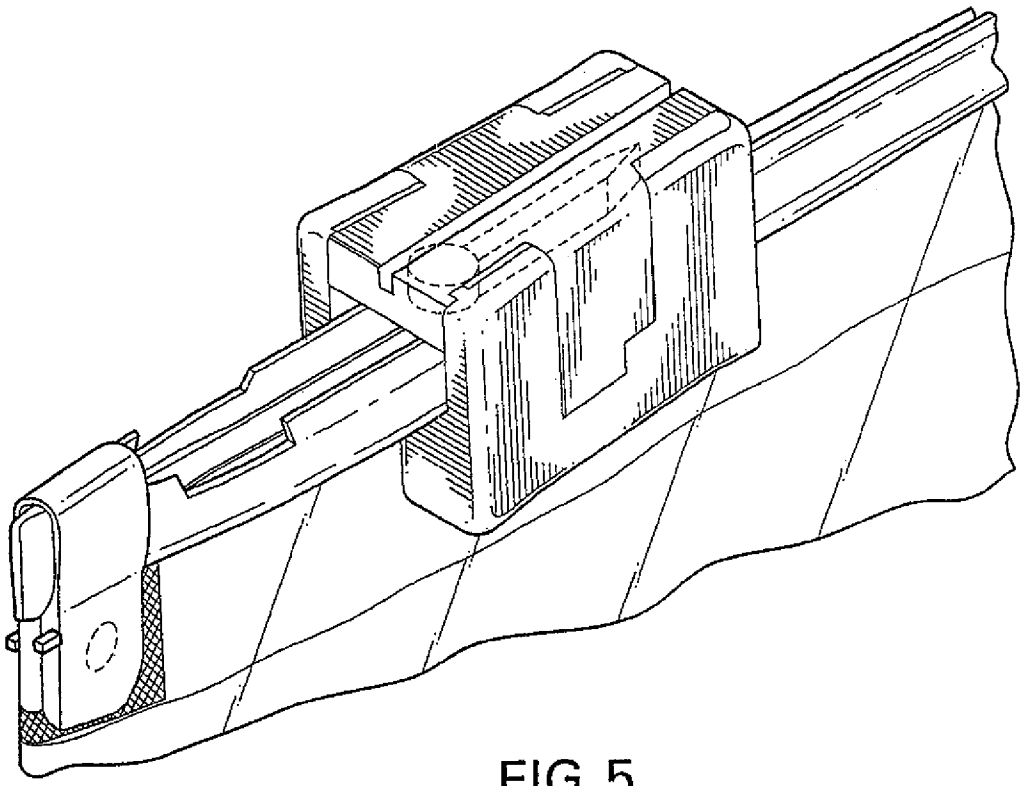
FIG. 5 is a perspective view of the reclosable fastener and slider in assembled position on a reclosable package.

In further accordance with the disclosed subject matter, and as depicted in FIGS. 3-5, the reclosable fastener comprises a pair of flexible plastic strips having separable fastener means extending along the length thereof comprising reclosable interlocking male and female profile elements on the respective strips. The strips include profiled tracks extending along the length thereof parallel to the male and female elements. The slider is provided with a separator finger and interlocking complementary structure formed from plastic for moving along the fastener in straddling relation. The complementary structure comprises a transverse support member having the separator finger depending therefrom. The support member is positioned on the top edges of the tracks with the separator finger inserted therebetween.

A pair of side walls are positioned on the opposite sides of the support member for receiving the pair of strips therebetween, the separator finger and the side walls extend from an opening end of the slider to a closing end. The separator finger is wider at the opening end of the slider than at the closing end of the slider and the side walls are spaced wider apart at the opening end to permit separation of the male and female elements by the wider end of the separator finger extending between the side walls at the opening end. The side walls are spaced sufficiently close together at the closing end to press the male and female elements into interlocking relationship as the slider is moved in a fastener closing direction.

There is further provided means for restraining the slider in closed position and maintaining the male and female elements in interlocking relation when the slider reaches the closed end of its travel along its tracks comprising a protrusion on the wider end of the separator finger adjacent the opening end of the slider and notch structure at the adjacent end of the tracks. The notch structure has an end located on the tracks to permit the wider end of the separator finger to move beyond the end from between the tracks and into the notch structure. The protrusion is engageable with the end of the notch structure when the slider is at the closed end of its travel on the tracks thereby restraining the wider end of the separator finger from moving out of the notch structure and between the tracks and inadvertently opening the male and female elements of the fastener, as shown and described in U.S. Pat. No. 5,067,208 to Herrington, Jr., the entire contents of which is incorporated herein by reference thereto.

Figure 6A:
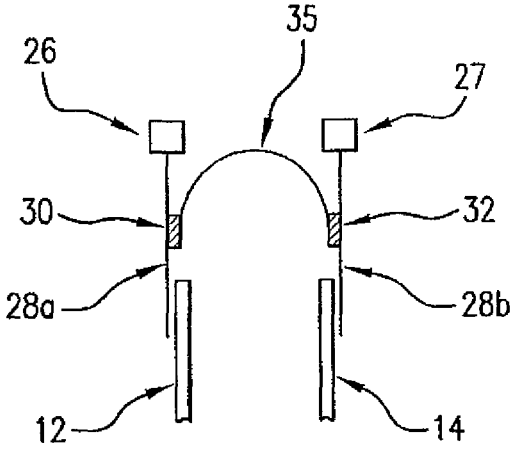
FIGS. 6A-8 are cross-sectional views of the reclosable fastener and sealing member in accordance with the disclosed subject matter.
Figure 6B:
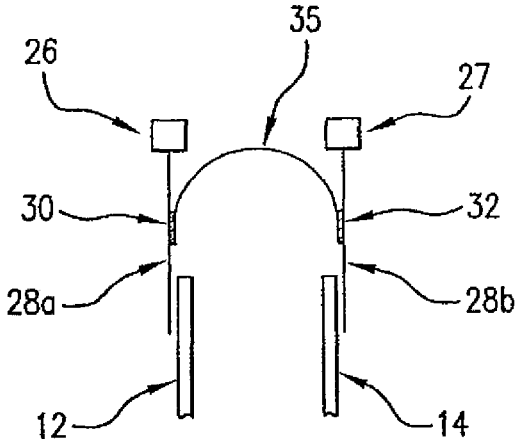
Figure 6C:
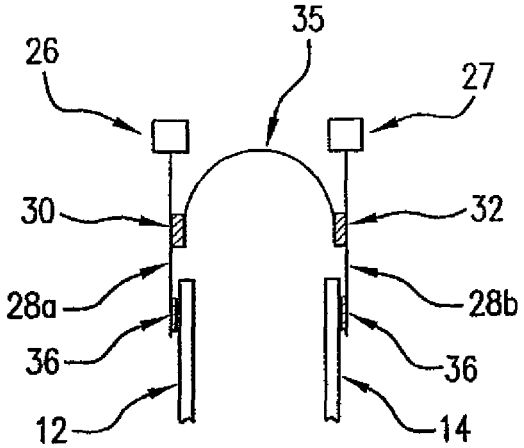
Figure 6D:
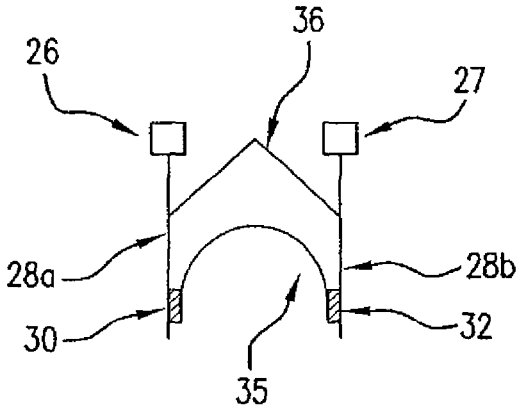
Figure 6E:
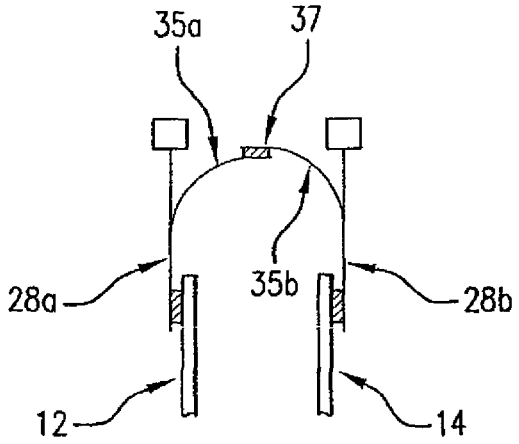
Figure 7:
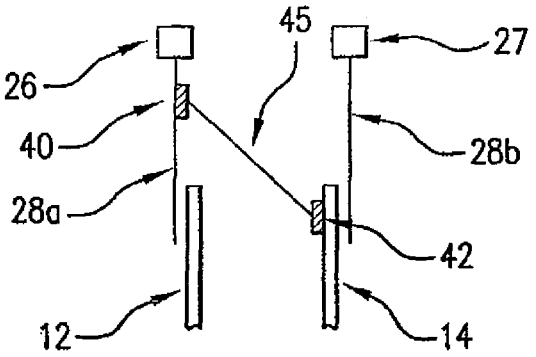
Figure 8:
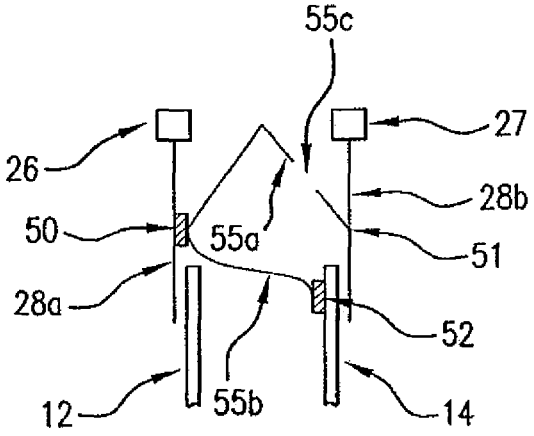
Figure 9:
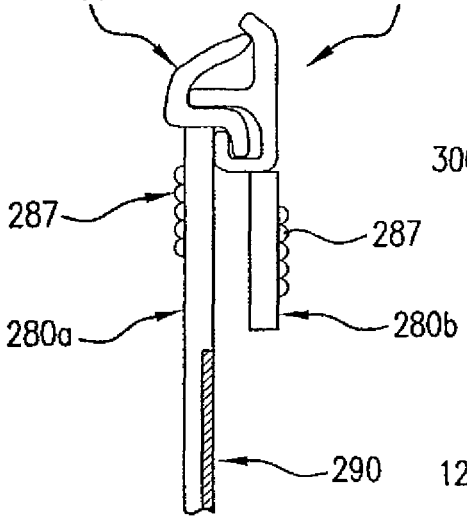
FIGS. 9-16 are cross-sectional views of the reclosable fastener and closure assembly in accordance with the disclosed subject matter.
Figure 10:
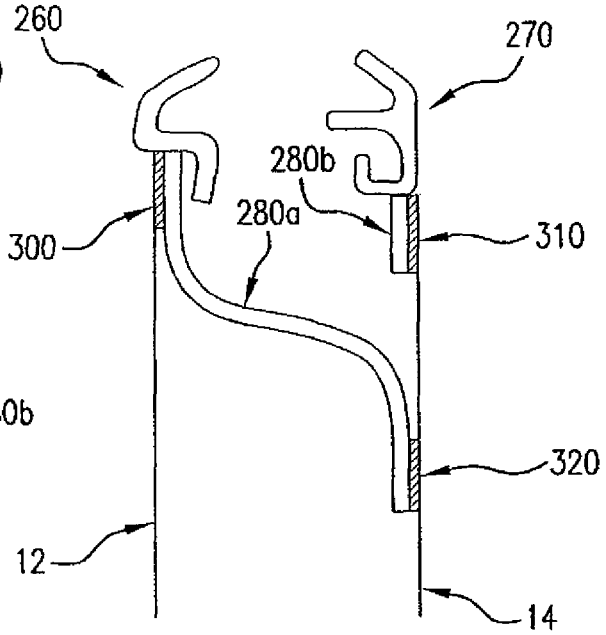

In accordance with one aspect of the disclosed subject matter, and as illustrated in the cross-sectional views of FIGS. 6-8, bag 10 comprises a closure assembly including interlocking fastener profiles 26, 27 and downwardly extending fins 28*a*, 28*b* which are joined to bag panels 12, 14. A sealing member 35 is also provided to resist high loads (e.g. burst forces) from the inside of the package, yet allow for an easy opening feature for the consumer.

In an exemplary embodiment, the fastener track material is extruded in a two-piece fashion with fastener profiles 26, 27 and a fins 28*a*, 28*b* having a downwardly extending length of approximately 1.5 inches. After extrusion of these two pieces, the sealing member 35 configured as a thin gauge of approximately 2-6 mils of web material is attached to the interior surfaces of the fastener track, for example, just below the profiles 26, 27. As such, the sealing member 35 forms a hermetic seal and also serves as a tamper evident membrane. Additionally, the sides and bottom of panels 12, 14 are joined to form a hermetic seal.

The sealing member 35 is extruded from a web of sealable co-ex material capable of forming a peelable seal. The extrusion of co-ex sealing materials such as low melt plastomers in specified areas allows the sealing member to form a hard or permanent seal, whereas areas which are devoid of co-ex low melt plastomer material facilitate the formation of peelable seals, which allow for consumers to access the package contents. The permanent or "lock-up" seals can be formed by combining a co-ex low melt plastomer with a peel-seal material known in the art to achieve a firm union. The peelable seals can be formed with the peel-seal material only, i.e., without the co-ex low melt plastomer composition.

Figure 13:
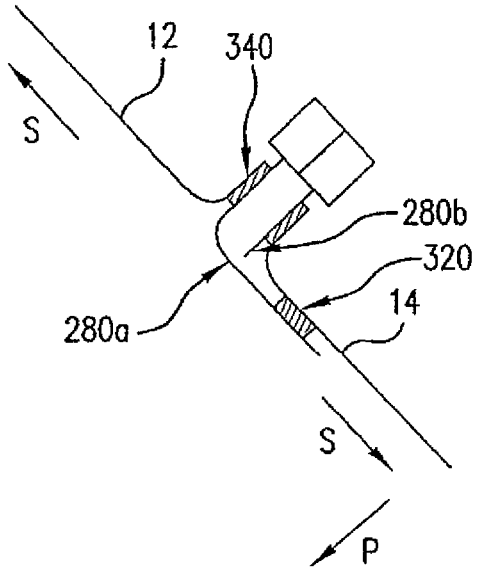

In accordance with an aspect of the disclosed subject matter, when a package is filled the gussets expand such that the panels are moved apart which in turn places shearing load "s" on the peelable seal 320, as shown in FIG. 13. The bond of the peelable seal has sufficient strength to resist shearing forces "s" induced by the contents, but is weak in the peal direction "p" which allows a consumer to easily rupture the peelable seal to gain access the contents of the package. Also, the bond formed between the closure fin and the bag panel at location 340 is a permanent, "lock-up" type which is capable of withstanding elevated loads regardless of the orientation of the loads.

The seals disclosed herein, i.e., either permanent or peelable, can be formed by a variety of techniques including adhesives, heat-seal, ultrasonic welding, etc. If ultrasonic welding is employed, it is advantageous to use a rotary ultrasonic wheel to form the seals since such an apparatus reduces the drag and heating of the closure assembly, thereby minimizing the formation of wrinkles and other undesirable deformations. The strength of the seals disclosed herein, i.e., either permanent or peelable, can be varied by altering the amount or type of adhesives, or the duration of the seal time in the case of heat-seal or ultrasonic welding. While any of these techniques can be employed to create either type of seal, i.e., permanent or peelable, one of ordinary skill in the art would appreciate that the forming of the permanent seal would include incorporating a suitable amount of the co-ex low melt plastomer at select locations in accordance with the invention.

In the embodiment exemplified in FIG. 6A, the seal member 35 has a first end attached to the fin 28*a* at location 30, and a second end attached to fin 28*b* at location 32. The seal member 35 can be attached to the fins by a permanent union such as a "lock-up" seal, or by a temporary union such as a peelable seal. Accordingly, the seal member can be attached to the fin in such a manner where both attachment points 30, 32 are configured as either lock-up seals, or alternatively, as peelable seals. Additionally, seal member 35 can be attached to the fins 28*a*, 28*b* utilizing a combination of different seal types, e.g. a lock-up seal 30 and a peelable seal 32 such that seal member 35 has a first end joined to a fin via a peelable seal and a second end joined to a fin via a "lock-up" seal. As discussed above, the permanent or "lock-up" seal is achieved by incorporating the co-ex, low melt material at the attachment point where it is desired to effectuate a hard seal. Alternatively, the different types of attachments, i.e. "lock-up" or peelable, can be achieved utilizing a variety of mechanical treatments instead of the particular material compositions disclosed herein.

Further, the bottom portion of the fins 28*a*, 28*b*, as illustrated in FIG. 6C, can include co-ex material at locations 34, 36 which further reduces the likelihood of tearing or undesired opening of the package due to a heavy fill-load. The presence of the co-ex material in the fin portions increases the strength of the union between the closure assembly and the bag panels. In some embodiments, the co-ex material in the fin members allows for the closure assembly to be configured such that the track extends beyond the sides of the bag panels 12, 14 to form an overlying portion. This overlying portion can serve as a handle or grip device which enables a consumer to conveniently grasp and lift the package, while the co-ex material incorporated into the track fins prevents the track from being tearing off the bag panels while exposed to the load. In this embodiment, the seal member 35 is a discrete structure which is formed separately from the panels and closure assembly.

Alternatively, and as illustrated in FIG. 6B, at least one end of the seal member 35 can be integrally formed with the fin 28*a*, e.g. by co-extrusion, such that the attachment point 30 represents an integrally formed union of the fin 28, and the sealing member 35. This configuration is advantageous in that the sealing member remains attached to the fin even after the peelable seal 32 is ruptured by the consumer. Therefore, the sealing member is not susceptible to accidentally mixing with the contents of the package.

In the embodiment illustrated in FIG. 6D, the closure assembly is extruded with a W-shape closure track having a membrane 36 which is integrally formed with and extends from the first fin 28*a* to the second fin 28*b*. Further, the sealing member 35 is attached to the fins 28*a*, 28*b* by a peelable seal at attachment locations 30, 32. The W-track membrane 36 can also be configured with a line of weakness, such as a score of perforations, which serve as a tamper evident device, alerting the consumer if the contents of the package have been accessed or damaged in any way. Thus, the sealing member 35 is preferably disposed below the membrane 36 to absorb any burst forces that may be generated. Alternatively, the sealing member 35 could be positioned above the W-track membrane 36, this arrangement renders the line of weakness formed in membrane 36 prone to rupture in the event that an internal force is imposed on the membrane 36, and is therefore not the preferred configuration.

FIG. 6E depicts another embodiment of the present disclosed subject matter in which the sealing member is comprised of two flaps 35*a* and 35*b* which are joined with a peelable seal 37. The fins can be attached to the panels by either a peelable seal or a permanent seal. This configuration is advantageous since the peel seal is placed in shear, as will be discussed further below. Also, the peel seal 37 is centrally located thus providing easy identification and access by the consumer. Once the peel seal 37 has been opened there are only two relatively short flaps 35*a*, 35*b* which remain on the interior surface of the fins rather than one long sealing member which may occlude or otherwise interfere with the package mouth. The flaps 35*a*, 35*b* could be extruded with the fins to form an integral assembly, or alternatively the flaps can be discrete structures separately attached to the fins.

The presence of the sealing member 35 is particularly advantageous in packages which are bottom filled, i.e. where the fill load is imparted directly on the closure assembly at the top of the package, since the sealing member shields the closure assembly and inhibits or prevents the undesired separation of interlocking profiles 26, 27. Accordingly, the closure configuration of the present disclosed subject matter is particularly suited for bottom filled packages, however the present disclosed subject matter can also be employed in top filled packages as described in further detail below and exemplified in U.S. Pat. Nos. 6,071,011 and 6,378,177, which are hereby incorporated by reference in their entirety.

In accordance with another embodiment of the disclosed subject matter, the sealing member 45 can be configured to attach to both a fin member 28*a*, and a bag panel 14, as shown in FIG. 7. Preferably, the sealing member 45 is attached to the bag panel 14 at location 42 by a peelable seal, and can be attached to the fin member 28*a* at location 40 by either a peelable seal or by a lock-up seal. In the event that a permanent lock-up seal is preferred, the fin member can be provided with a sealant layer, e.g. co-ex material, as described above. This embodiment is advantageous in that it simplifies the manufacturing, i.e. extrusion, process and allows for customizable film webs as well as tailorable peel seals.

Similarly, FIG. 8 illustrates an additional embodiment wherein the sealing member has two portions 55*a*, 55*b* and three attachment points 50, 51, 52. The first portion of the sealing member 55*a* is attached to the first fin 28*a* at location 50, preferably by a permanent lock-up seal. Also, the first portion of the sealing member 55*a* is attached to the second fin member 28*b* at location 51 which represents a co-extruded portion of the sealing member 55*a* and the fin member 28*b*, such as in the W-track configuration discussed above. A second portion of the sealing member 55*b* extends below the first portion 55*a* and is attached to a bag panel 14 at location 52, preferably by a peelable seal which is contained within the sealing member 55*b* and not the bag panel 14. Additionally, the sealing member 55*a* includes a score or line of weakness designated by void 55*c* which serves as a tamper evident feature.

Figure 11:
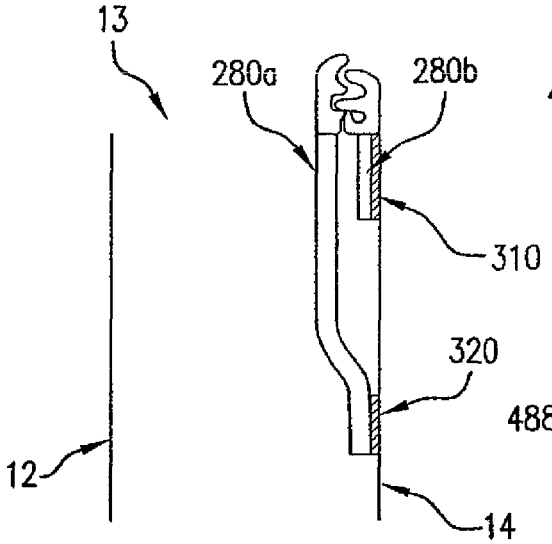

In accordance with another embodiment of the disclosed subject matter, illustrated in FIGS. 9-16, the closure assembly can include fins 280*a*, 280*b* which can be configured with sealing ribs 287 to facilitate permanent lock-up seals between the fins 280 and the bag panels 12, 14 at locations 300 and 310. Further, a bottom portion of the first fin 280*a* can extend below the second fin 280*b* and can be formed with co-ex material and can form a peelable seal 290 between the bottom portion of the first fin 280*a* and the second bag panel 14 at location 320. As shown in FIG. 11, this embodiment is particularly suited for top-fill packages, wherein upon loading of the contents through the mouth 13 of the package, the film panel 12 can be joined to the fin 280*a* with a permanent lock-up seal.

Figure 12:
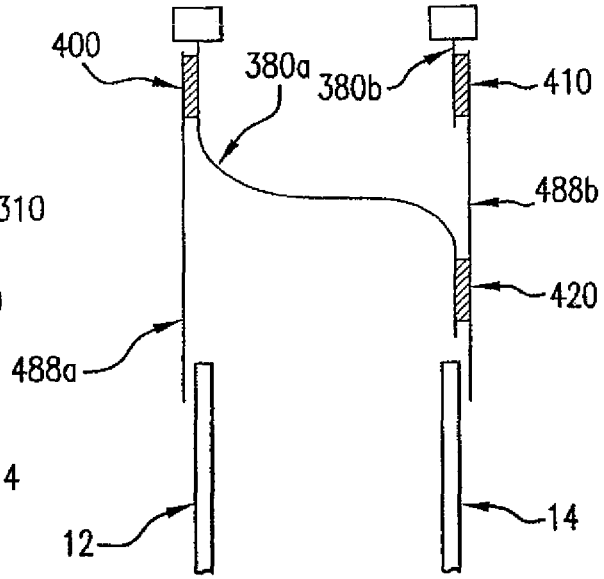

FIG. 12 depicts a similar embodiment wherein the fin members 380*a*, 380*b* are attached to short film webs 488*a*, 488*b* with permanent lock-up seals 400, 410.

The first fin member 380*a* extends downward a greater distance than the second fin member 380*b*, and is attached to the second short film web 488*b* at location 420 with a peelable seal. The use of such short film webs 488*a*, 488*b* allows greater flexibility in the manner in which the closure assembly is attached to the bag since the short film webs 488*a*, 488*b* can be attached to either the interior surface or exterior surface of the bag panels 12, 14. While FIGS. 9-12 illustrate first fin 280*a* extending below second fin 280*b*, it is to be understood that this arrangement could be reversed so that the second fin 280*b* extended below first fin 280*a* and attached to panel 12.

Figure 14A:
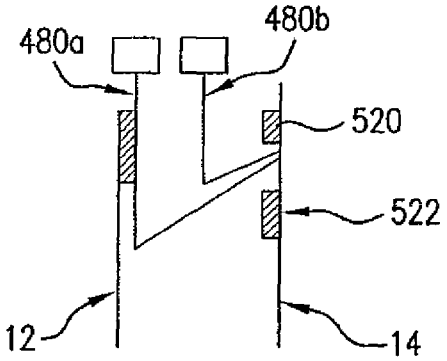
Figure 14B:
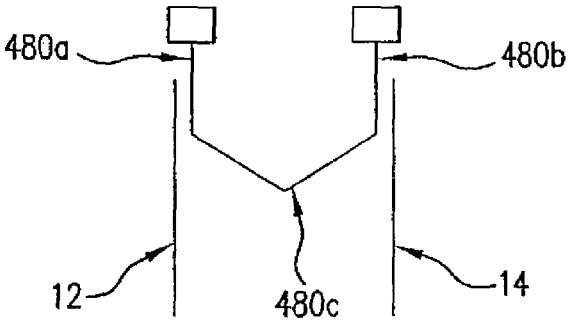
Figure 15:
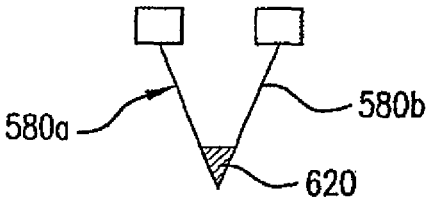

In another embodiment of the disclosed subject matter, the fin members 480*a*, 480*b* are configured as an integral fin having a folded portion which is attached to the panel 14 at two locations 520, 522 with peelable seals, as shown in FIGS. 14A-B. Additionally, the folded portion of the fin includes a line of weakness 480*c* which can serve as a tamper evident feature. However, the line of weakness is protected from any fill loads or burst pressure by the geometry of the fold which does not have any weakened areas. Consequently, the line of weakness in the fin 480 is ruptured by the consumer to gain access to the contents, and not due to elevated fill loads or drop tests. In an alternative configuration shown in FIG. 15, the fins 580*a*, 580*b* can be attached to each other with a peelable seal 620 which has sufficient strength to withstand elevated internal forces, yet allows a consumer to access the contents of the package.

Figure 16:
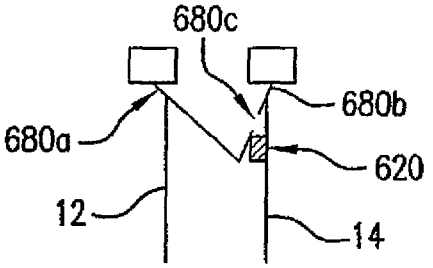

FIG. 16 illustrates a closure assembly with fin members 680*a*, 680*b* which are attached to panels 12, 14 and wherein the fin member 680*b* includes a score or area of weakness 680*c*. This area of weakness 680*c* allows a user to pierce through the fin member and rupture the peelable seal 620 and access the contents of the package. The closer the peelable seal 620 is located to the mouth of the package, the more the panels will be able to expand and thus dissipate internal forces.

As discussed above, the peelable seal portions are formed devoid of co-ex material, and thus form a weaker union than the permanent lock-up seals. Consequently, areas of the bag which include a peelable seal material are more susceptible to rupture.

However, both the fins 280 and the sealing member 35, either of which can include a peelable seal, can be received between opposing bag panels 12, 14 and extend laterally across the entire width of the bag so as to span from one edge 18*a* to a second edge 18*b*. Therefore, the presence of the peelable seal material at the edges 18*a, b* can interrupt or weaken the union of bag panels 12, 14 along the edges 18*a, b* and thus be detrimental to the bags performance.

Figure 17:
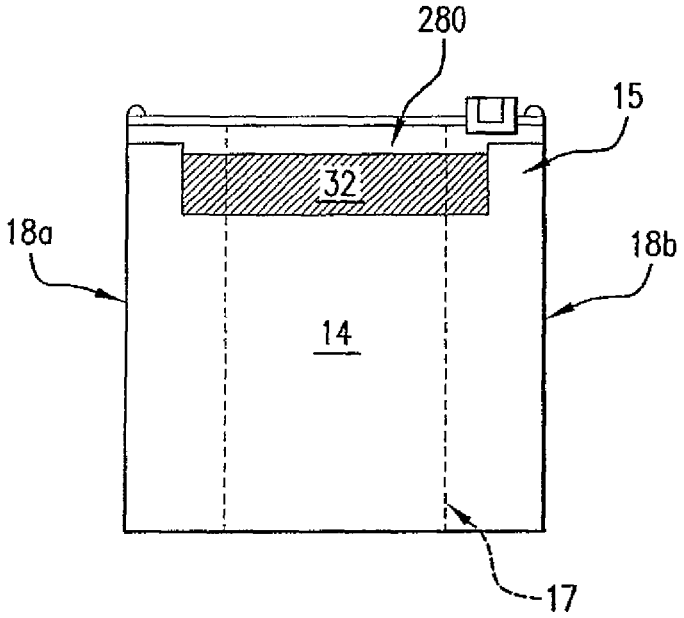
FIG. 17 is a front view of the reclosable package depicting a notch formed in the sealing member in accordance with the disclosed subject matter.

Therefore, and in accordance with another aspect of the disclosed subject matter, the peelable seal material, whether formed via the fin 280 or seal member 35 as described in the various embodiments above, can include a cut-out or notch portion 15 adjacent to one, or both, edges 18*a*, 18*b* of the bag. The notches 15 are configured to extend a lateral distance towards the center of the bag and a vertical distance towards the bottom of the bag. While the exemplary embodiment illustrated in FIG. 17 depicts linear notches 15 formed in the fins 280, it is to be understood that the notches can be formed in a variety of shapes and sizes, and in either the fins 280 or seal member 35, as so desired. In some embodiments, the notch can be configured to extend along the entire height of the peelable seal material such that no portion of the peelable seal material is located at the side edges of the film panels 12, 14.

Providing a notch in the peelable seal material proximate an edge 18*a*, 18*b* of the bag allows for a stronger seal along the sides of panels 12, 14 and further enhance the bags resistance to burst pressure. Additionally, in embodiments in which the fins 280 and/or seal member 35 are formed from a different material than the bag panels 12, 14, the notch 15 allows for sealing of only homogeneous materials at the edge (i.e., only the bag panels 12, 14), thereby reducing the chance of pin holes being formed at the sides resulting in a faulty seal.

The notch 15 can be provided, for example in the fins 280, by removing material from a portion of the fins 28 that includes the peelable seal material. The fins 280 can then be inserted between the panels 12, 14 and positioned such that the notched region 15 is registered with the edges 18*a, b*. The bag panels 12, 14 can then be sealed along the edges 18*a*, b and bottom 16 via any of the sealing techniques described above. Therefore, the peelable seal can be configured to extend a distance between the edges 18*a, b* of the bag which is less than the width of the bag. Further, in embodiments in which the notch 15 is configured to extend along the entire height of fin 280 such that no portion of the peelable seal material is located at the edges, the profile of the sealed bag edges 18*a, b* remains uniform along the entire height of the bag, i.e., from the bottom to the mouth of the bag.

Additionally, areas of weakness such as perforations can be formed at select locations along the closure assembly thereby allowing the majority of the track fin to remain in-tact and capable of withstanding the forces generated from filling or dropping the package. Areas of weakness in the side gusset, if present, are particularly beneficial since the gusset allows for forces to be dissipated by the expansion of the panels and thus protects the area of weakness. Indicia such as printed directions, or color codes, can be provided along the closure assembly to aid a consumer in locating the areas of weakness to facilitate opening of the package.

Figure 18:
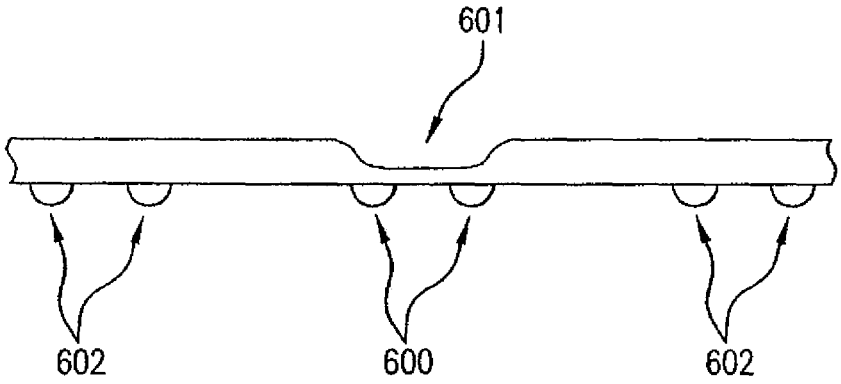
FIG. 18 is a cross-sectional views of the closure assembly in accordance with the disclosed subject matter.

Furthermore, ribs can be provided on the closure assembly in order to ensure that the area of weakness is provided with a predictable and controlled rupture, especially for packages requiring over 13 lbs. force to open. In the configuration shown in FIG. 18, the rib design channels the opening of the area of weakness 601 between adjacent ribs 600, which will orient the tear in the machine direction. The ribs 600 are positioned between sealing ribs 602. Additionally, resins can be used to aid in the orientation of tearing or opening of the area of weakness.

While the present disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the present disclosed subject matter without departing from the spirit or scope of the disclosed subject matter. Thus, it is intended that the present disclosed subject matter include modifications and variations that are within the scope of the appended claims and their equivalents.

The invention claimed is:

1. A process for forming, filling, and sealing a package through the bottom comprising:

providing at least one web of material;

forming from the at least one web of material a first panel including a first side, a second side, a top and a bottom, and a second panel including a first side, a second side, a top and a bottom;

positioning the first panel in opposite relationship to the second panel;

joining the first panel to the second panel along the first and second sides to define a package interior having a mouth disposed proximate the bottom of each of the first and second panels and side edges defined along the first and second sides, wherein a package width is defined between the side edges;

attaching a closure assembly extending along the top of each of the first and second panels, including attaching a first fin having a first portion of a reclosable fastener to an exterior surface of the first panel and attaching a second fin having a second portion of the reclosable fastener to an exterior surface of the second panel;

attaching a sealing member defined by a separate web having a first end and a second end and an intermediate portion therebetween, including attaching the first end to the first fin at a location between the top of the first panel and the first portion of the reclosable fastener and attaching the second end to the second fin at a location between the top of the second panel and the second portion of the reclosable fastener, with the intermediate portion extending from the first and second ends in a direction opposite the bottom of each of the first and second panels, wherein at least one of the first end or second end is attached with a peelable seal, the peelable seal extending between the side edges a distance less than the package width;

inserting a product through the mouth, whereby the sealing member is configured to shield the closure assembly from a load applied by the product; and joining the first panel to the second panel along the mouth to close the product within the package interior.

2. The process for forming, filling, and sealing a package through the bottom of claim 1, wherein the first end of the sealing member is attached to the first fin with the peelable seal, and the second end of the sealing member is attached to the second fin with a lock-up seal.

3. The process for forming, filling, and sealing a package through the bottom of claim 1, wherein the first end of the sealing member is attached to the first fin with the peelable seal, and the second end of the sealing member is attached to the second fin with a second peelable seal.

4. The process for forming, filling, and sealing a package through the bottom of claim 1, further comprising a membrane having a first end attached to the first fin and a second end attached to the second fin, with a line of weakness formed at a point between the first and second ends.

5. The process for forming, filling, and sealing a package through the bottom of claim 4, wherein the membrane is disposed below the sealing member.

6. The process for forming, filling, and sealing a package through the bottom of claim 4, wherein the membrane is disposed above the sealing member.

7. The process for forming, filling, and sealing a package through the bottom of claim 1, wherein the sealing member can be removed from the reclosable package.

8. The process for forming, filling, and sealing a package through the bottom of claim 1, wherein the peelable seal is formed by adhesives, heat-seal, or ultrasonic bonding.

9. The process for forming, filling, and sealing a package through the bottom of claim 1, wherein at least a portion of at least one fin includes a co-ex material.

10. The process for forming, filling, and sealing a package through the bottom of claim 9, wherein terminal ends of at least a portion of the first and second fins which are attached to the panels include a co-ex material.

11. The process for forming, filling, and sealing a package through the bottom of claim 1, wherein the sealing member, panels, and fins are discrete structures.

12. The process for forming, filling, and sealing a package through the bottom of claim 1, wherein a lower portion of the first fin is attached to the first panel with a lock-up seal.

13. The process for forming, filling, and sealing a package through the bottom of claim 1, wherein the second fin is attached to the second panel with a lock-up seal.

* * * * *